US010043350B2

(12) United States Patent
Gomez et al.

(10) Patent No.: US 10,043,350 B2
(45) Date of Patent: Aug. 7, 2018

(54) CASINO GAME WITH PERIPHERAL RING OF SCATTER SYMBOLS AROUND CENTER REELS

(71) Applicant: Gemini Digital Development, Inc., Las Vegas, NV (US)

(72) Inventors: Ben Gomez, Chicago, IL (US); James P. Jackson, Henderson, NV (US); Alfred Thomas, Las Vegas, NV (US)

(73) Assignee: GEMINI DIGITAL DEVELOPMENT, INC., Las Vegas, NV (US)

( * ) Notice: Subject to any disclaimer, the term of this patent is extended or adjusted under 35 U.S.C. 154(b) by 599 days.

(21) Appl. No.: 14/338,792

(22) Filed: Jul. 23, 2014

(65) Prior Publication Data

US 2015/0031437 A1 Jan. 29, 2015

Related U.S. Application Data

(60) Provisional application No. 61/857,577, filed on Jul. 23, 2013.

(51) Int. Cl.
*G07F 17/32* (2006.01)
*G07F 17/34* (2006.01)

(52) U.S. Cl.
CPC ..... *G07F 17/34* (2013.01); *G07F 17/3213* (2013.01); *G07F 17/3267* (2013.01)

(58) Field of Classification Search
CPC .. G07F 17/3267; G07F 17/3213; G07F 17/34; G07F 17/3258; G07F 17/326; G07F 17/3262
See application file for complete search history.

(56) References Cited

U.S. PATENT DOCUMENTS 4,732,386 A * 3/1988 Rayfiel ..... A63F 3/0625 273/142 H
5,152,529 A * 10/1992 Okada ..... G07F 17/3213 273/143 R (Continued)

OTHER PUBLICATIONS

"The Silicon Gaming Odyssey Slot Machine," Levinthal, et al. (IEEE Xplore database, ieeexplore.ieee.org, 1063-6390/97, 1997).*

*Primary Examiner* — David L Lewis
*Assistant Examiner* — Matthew D. Hoel
(74) *Attorney, Agent, or Firm* — Patent Law Group LLP; Brian D. Ogonowsky

(57) ABSTRACT

A gaming machine displays a set of virtual center reels, creating an M×N array of symbols, and an independent set of virtual peripheral reels surrounding the M×N array. The peripheral reels are part of a secondary game, and each peripheral reel displays only one symbol position. The center reels contain at least one trigger symbol for trigging the secondary game. Each of the reels spins and randomly stops. Awards are granted for winning symbol combinations on the center reels. If the trigger symbol is displayed in the M×N array, or other trigger condition exists, a bonus award is granted for winning symbol combinations on the peripheral reels. The bonus award may be based on the number of peripheral symbols that match the displayed trigger symbol or may be based on other criteria. In one embodiment, the trigger symbols are only on one of the center reels.

20 Claims, 3 Drawing Sheets

(56) References Cited

U.S. PATENT DOCUMENTS 5,205,555 A * 4/1993 Hamano ..... G07F 17/3244 273/143 R
5,722,891 A * 3/1998 Inoue ..... G07F 17/34 273/143 R
5,752,881 A * 5/1998 Inoue ..... G07F 17/3211 273/143 R
5,848,932 A * 12/1998 Adams ..... G07F 17/32 463/20
5,882,261 A * 3/1999 Adams ..... A63F 7/027 273/121 B
5,911,418 A * 6/1999 Adams ..... A63F 3/00157 273/142 R
6,162,121 A * 12/2000 Morro ..... G07F 17/32 463/16
6,186,894 B1 * 2/2001 Mayeroff ..... G07F 17/32 273/138.1
6,224,484 B1 * 5/2001 Okuda ..... G07F 17/32 463/17
6,227,971 B1 * 5/2001 Weiss ..... G07F 17/3244 273/143 R
6,375,570 B1 * 4/2002 Poole ..... G07F 17/3211 463/20
6,702,675 B2 * 3/2004 Poole ..... G07F 17/3211 463/20
6,832,957 B2 * 12/2004 Falconer ..... G07F 17/34 463/20
6,896,617 B2 * 5/2005 Daly ..... G07F 17/32 273/143 R
7,371,170 B2 * 5/2008 Cregan ..... G07F 17/3265 273/138.1
7,578,735 B2 * 8/2009 Frizzell ..... G07F 17/3265 273/138.1
9,011,233 B2 * 4/2015 Ryan ..... G07F 17/3244 463/16
9,098,847 B2 * 8/2015 Basallo ..... G07F 17/3267
9,098,973 B2 * 8/2015 Basallo ..... G07F 17/3244
9,177,447 B2 * 11/2015 Zoltewicz ..... G07F 17/326
9,202,345 B2 * 12/2015 Zoltewicz ..... G07F 17/326
9,430,900 B2 * 8/2016 Zoltewicz ..... G07F 17/326
9,466,169 B2 * 10/2016 Basallo ..... G07F 17/3267
9,495,839 B2 * 11/2016 Aoki ..... G07F 17/326
9,633,506 B2 * 4/2017 Basallo ..... G07F 17/3267
2004/0012145 A1 * 1/2004 Inoue ..... G07F 17/3213 273/143 R
2005/0130731 A1 * 6/2005 Englman ..... G07F 17/32 463/20

* cited by examiner

CASINO GAME WITH PERIPHERAL RING OF SCATTER SYMBOLS AROUND CENTER REELS

CROSS-REFERENCE TO RELATED APPLICATIONS

This application claims priority to U.S. provisional application Ser. No. 61/857,577, filed on Jul. 23, 2013, assigned to the present assignee.

FIELD OF THE INVENTION

This invention relates to gaming devices, such as video slot machines, and, in particular, to a secondary game where randomly selected scatter symbols surround a center reel array.

BACKGROUND

Conventional reel-type video slot machines accept the player's bet of credits, initiate the spinning of virtual reels, randomly stop the reels to display a final array of symbols, then grant an award to a player based on the occurrence of winning symbol combinations across paylines and based on the player's initial bet per payline.

It would be more interesting for the player if an additional secondary game were also played. Ideally, the secondary game would have the potential of awarding very high awards, yet would have a high win frequency for lower value awards. The secondary game should also not take too much time to play and be simple to understand.

SUMMARY

In one example, a video gaming machine displays five center reels with three displayed symbols per reel, forming a 5×3 matrix of symbols. There may be 25 or more different paylines across the five reels. Surrounding the five center reels are independently spun peripheral scatter symbol reels. Scatter symbols can form winning combinations irrespective of their positions. To form a ring of scatter symbols around the center 5×3 matrix of symbols, where all the symbols are of the same size, 20 peripheral reels are needed. In one embodiment, there are about ten different symbols on the center reels and only three different-type scatter symbols on the peripheral reels. Blanks may also be added to the peripheral reels.

Most of the symbols on the center reels are conventional symbols that are used to create winning combinations across paylines. At least some of the center reels also include trigger symbols that trigger the secondary game involving the peripheral reels. In one embodiment, the secondary game is triggered by the display of only a single trigger symbol on the center reels. The trigger symbols may also be wild symbols for creating winning symbols combinations on the center reels.

To enhance the player's excitement, the center reels are stopped first so the player can see whether a trigger condition has occurred. Then the peripheral reels are sequentially stopped so the player can focus on the secondary game.

In one embodiment, there are multiple trigger symbol types, such as three types. Each trigger symbol type directly corresponds with a particular type of scatter symbol that can be displayed by the peripheral reels. In one embodiment, each type of trigger symbol is identical to a corresponding scatter symbol on the peripheral reels.

If a trigger symbol of a certain type is displayed on the center reels in the main game, and after an award is granted for the main game, all the same type scatter symbols displayed by the peripheral reels are highlighted, and a bonus award is granted based on how many of that type of scatter symbol is displayed by the peripheral reels.

In one embodiment, all the trigger symbols are only included on the fifth (rightmost) reel, and only one trigger symbol can be displayed at a time. There is at least one type of trigger symbol for each type of scatter symbol on the peripheral reels.

In one embodiment, if multiple different trigger symbols are displayed, two bonus awards are granted, one for each scatter symbol type displayed by the peripheral reels. If two of the same type of trigger symbols is displayed, the bonus award is doubled or otherwise multiplied.

In one embodiment, the image of the trigger symbols is unrelated to the image of the scatter symbols. In that embodiment, a certain combination of the trigger symbols on the center reels triggers the secondary game. The bonus award is based on winning combinations of the scatter symbols on the peripheral reels, in accordance with a displayed paytable.

The scatter symbols may include high value scatter symbols or all equal value scatter symbols. The bonus award may increase non-linearly with the number of matching scatter symbols so that there is a possibility of a very high bonus award. The different trigger symbols and scatter symbols may have different probabilities of occurring (weighted probabilities). As seen, there is a wide range of possibilities in designing the reel strips for the center reels and the peripheral reels which allow the designer to provide for a high bonus win frequency when a trigger symbol is displayed, yet also provide for a low frequency of very high bonus awards. If blanks are also included on the scatter reels, the design flexibility is further increased.

If the secondary game results in no bonus win, a consolation award may be granted.

In another embodiment, after a triggering event, the occurrence of a certain number of the same scatter symbols triggers another bonus game, which may be an interactive game where the player picks certain icons with hidden awards or any other type of special bonus game.

Many different types of games may use the concept of a ring of "single symbol" peripheral reels surrounding conventional center reels, where each peripheral reel is independently spun and stopped, and any bonus award is based on the scatter symbols displayed by the peripheral reels. The secondary game takes very little time to play since it is run concurrently with the main game, and the game is easy to understand.

The game may also be implemented with motorized physical reels as the center reels and/or the peripheral reels. In one embodiment, the center reels are physical reels and the peripheral reels are displayed on one or more display screens.

Other variations are described.

The game applies equally to stand-alone gaming machines in a casino, on-line games using a home computer, and games played on portable devices (e.g., smartphones).

DETAILED DESCRIPTION

Although the invention can typically be implemented by installing a software program in most types of modern video gaming machines, one particular gaming machine platform will be described in detail.

Figure 1:
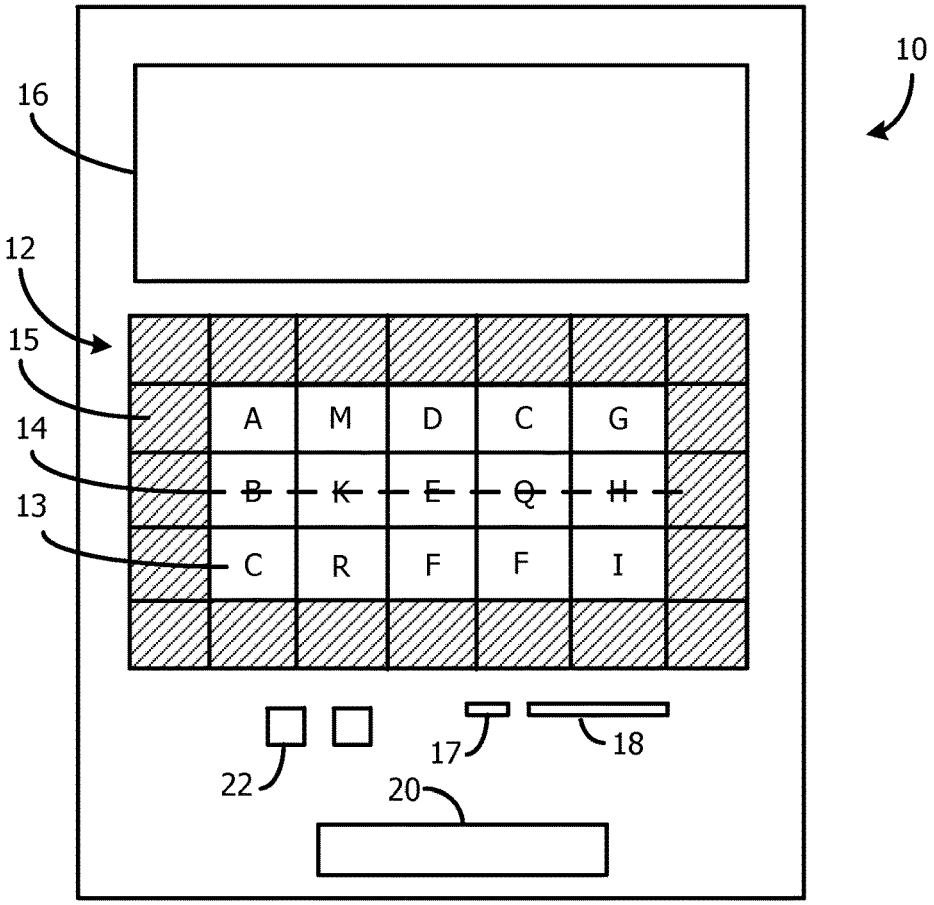
FIG. 1 illustrates a gaming machine that displays a reel-type game on a video screen and is programmed to perform the inventive secondary game.

FIG. 1 illustrates a video gaming machine 10 that incorporates the present invention. The machine 10 includes a bottom display 12 that may be any flat panel color display or any other type of display. In the example shown, the main game shown on the display 12 is the random selection of a 5×3 array of symbols on five virtual reels 13, where an award is granted based on the combination of symbols across any number of paylines, such as the payline 14. The array of symbols may also be a 5×4 array of symbols, a 3×3 array of symbols, or any other size or shape array.

The display 12 also shows a secondary game employing 20 independently spun peripheral reels 15 (or secondary reels), shown cross-hatched. The 20 reels 15 surround the main game reels 13. The symbols displayed on the reels 15 are all scatter symbols since there is no payline associated with winning combinations of symbols on the reels 15. Surrounding the main game with the ring of "single symbol" reels 15 is an effective and efficient way of displaying the secondary game, since the scatter symbols are easy to comprehend by the player and there needs to be no transition to another game motif to play the secondary game. The secondary game is essentially played concurrently with the main game, so the betting frequency is not significantly slowed by the secondary game.

There may be any number of the peripheral reels 15, but the arrangement shown in the figures is the most aesthetically pleasing, and providing 20 reels 15 offers a wide range of symbol selection probabilities in the secondary game.

A top display 16 is an optional video screen that may display a bonus game, or the paytable, or the game's theme, or any other information. The display 16 may instead be backlit painted glass. The top display 16 may also be an extension of the display 12.

A coin slot 17 accepts coins or tokens in one or more denominations to generate credits within the machine 10 for playing games. An input slot 18 accepts various denominations of banknotes or machine-readable tickets, and may output printed tickets for use in cashless gaming. A coin tray 20 receives coins or tokens from a hopper upon a win or upon the player cashing out. Player control buttons 22 include any buttons needed for the play of the particular game or games offered by machine 10 including, for example, a bet button, a spin reels button, a cash-out button, and any other suitable button. Buttons 22 may be virtual touch screen buttons.

In the below scenario, it is assumed that the software program for playing the inventive game is installed in a standalone gaming machine. However, the program may be downloaded to any processing device using a display screen for playing the game. The credits bet may represent a monetary amount (such as for a casino game) or a non-monetary amount (such as where the game is played solely for amusement), and any award may represent a monetary amount or a non-monetary amount.

Figure 2:
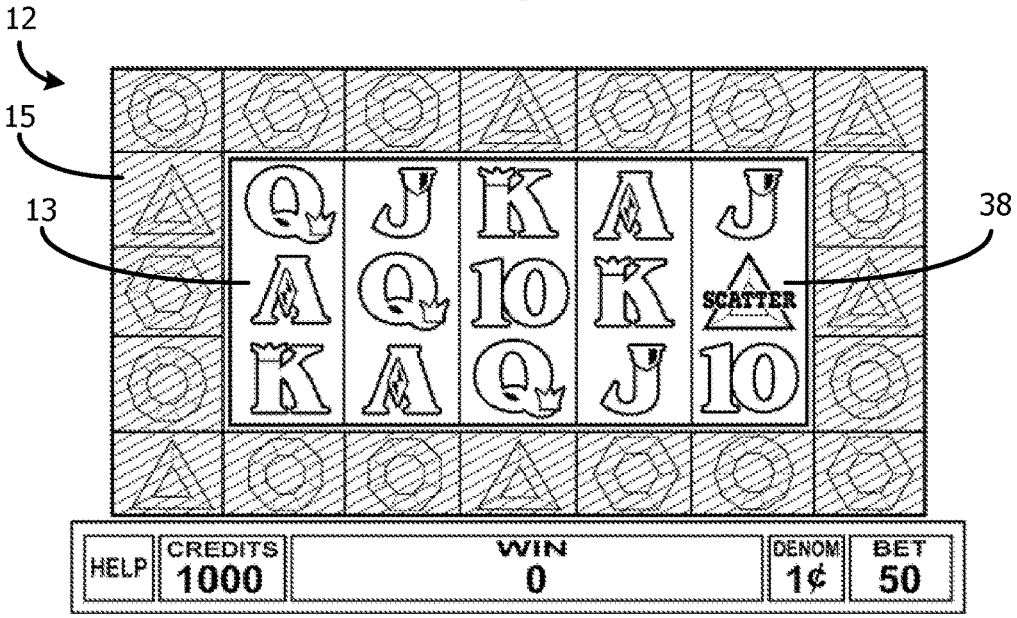
FIG. 2 is a simulated screen shot after five center reels and 20 peripheral reels have been randomly stopped.
Figure 3:
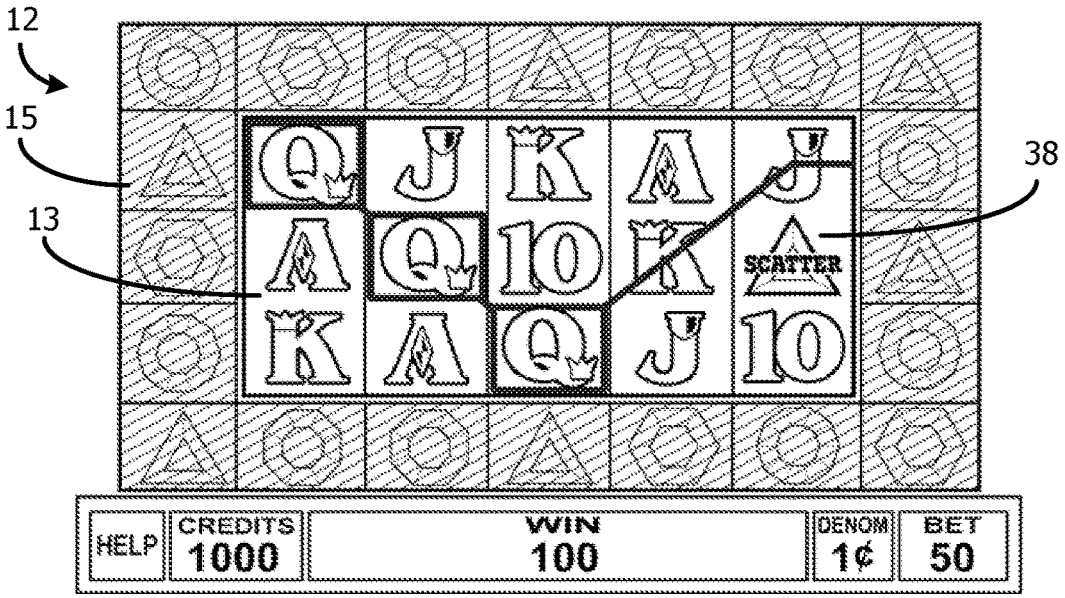
FIG. 3 illustrates a winning symbol combination in the center reels being highlighted and an award granted for the winning symbol combination.
Figure 4:
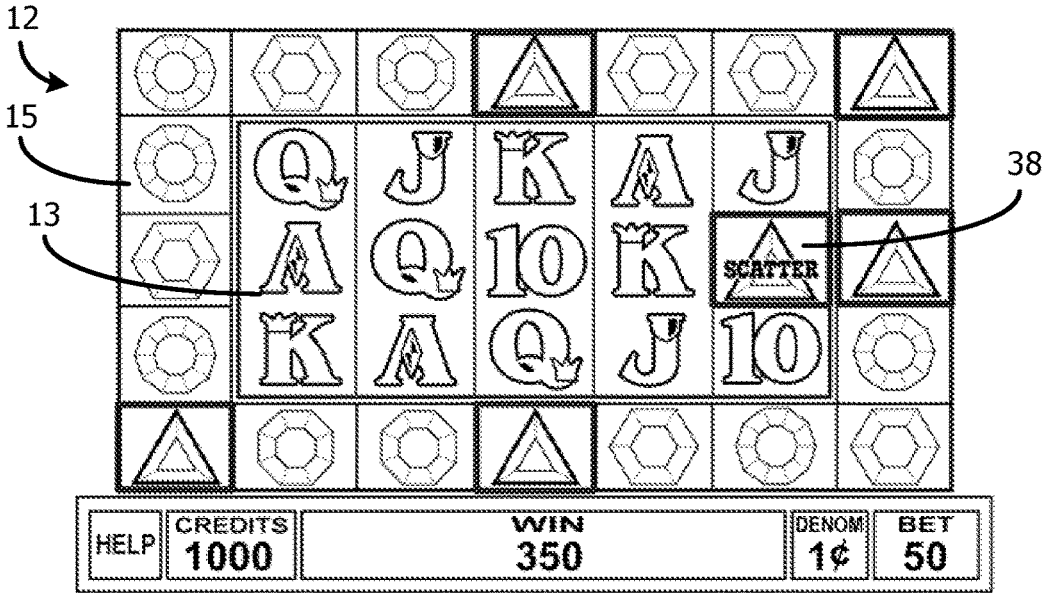
FIG. 4 illustrates how the occurrence of a trigger symbol in the center array of symbols caused the peripheral reels to be highlighted and relevant scatter symbols being identified for granting a bonus award.

FIGS. 2-4 show more detailed images displayed on the display 12 for a single game. The description of the game will also reference the flowchart of FIG. 5.

Figure 5:
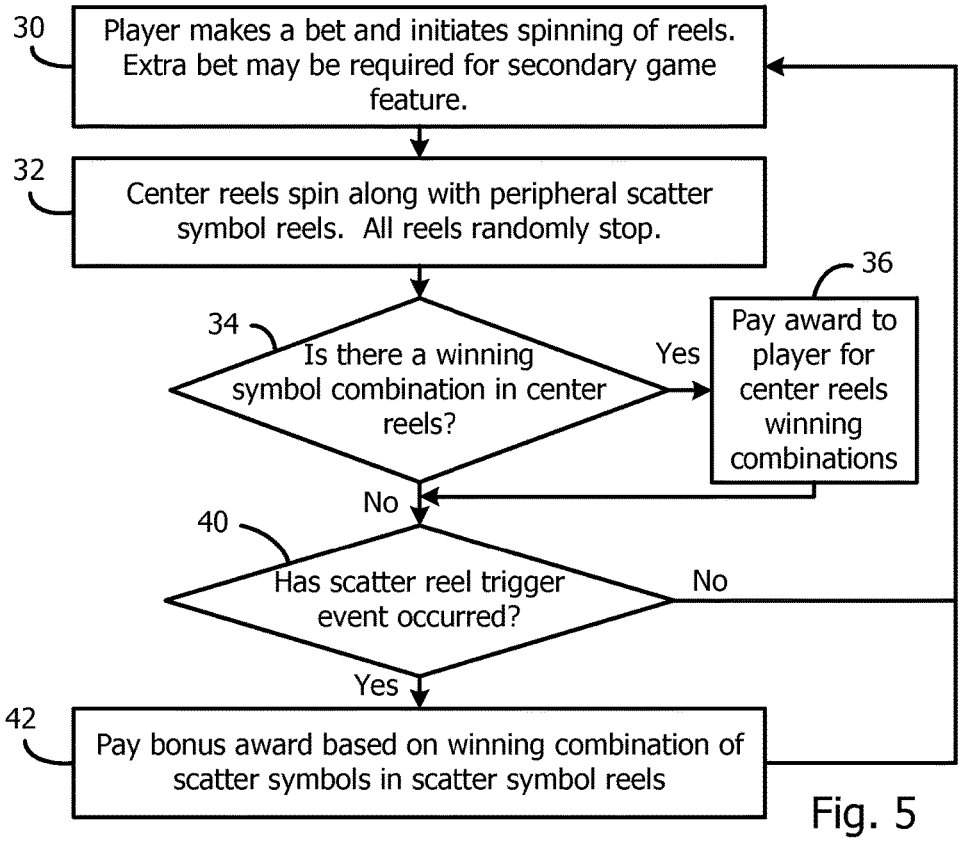
FIG. 5 is a flowchart identifying various steps performed in accordance with an embodiment of the invention.

In step 30 of FIG. 5, the player makes a bet. FIG. 2 illustrates that the player has a bank of 1000 credits and has made a bet of 50 credits (two cents per payline). In one embodiment, the player has to make a special added bet to activate the secondary game. This added bet may be used to fund the secondary game if the paytable for the main game is to be unaffected by the addition of the secondary game.

In step 32, the player then presses a button to simultaneously spin all the center reels 13 and all the peripheral reels 15. A pseudo-random number generator in the gaming machine 10, which may be a subroutine running on the machine's CPU, determines the stopping position of each of the center reels 13 and each of the peripheral reels 15. A software routine animates the reels spinning and stops the reels in sequence starting from the leftmost one of the center reels 13. The peripheral reels 15 are then stopped in sequence starting from the top left peripheral reel and going around the ring so the player can better focus on the unfolding secondary game.

The resulting stopped display is shown in FIG. 2. In FIG. 2, the peripheral reels 15 are darkened to focus attention on the center reels 13. In an actual embodiment, this may not be the case, and the scatter symbols are the type that are very distinguishable from the symbols on the center reels 13 to easily distinguish the two types of symbols. In FIG. 2, the scatter symbols have a gem theme, while the center symbols have a playing card theme.

The award for the center array of symbols is first determined.

In step 34, the CPU determines if there is a winning combination of symbols on the center reels 13 in the 5×3 array.

FIG. 3 illustrates that there is a winning combination of symbols (three Queens) along the illustrated payline.

In step 36, the player is granted an award for the three Queens based on a paytable. Note that there is a secondary game trigger symbol 38 that was displayed on the rightmost center reel 13. This trigger symbol 38 (having a gem theme) acts as a wild symbol for symbols on the same payline, but no winning combinations occurred using the wild symbol in the example. FIG. 3 illustrates that the player has been awarded 100 credits for the three Queens.

In step 40, it is determined by the CPU whether there is a trigger condition for playing the secondary game. In the embodiment shown, there are only trigger symbols 38 on the rightmost reel 13 so that only one trigger symbol 38 at a time can appear on the display 12. However, in other embodiments, the trigger symbols for the secondary game are on multiple reels, and the trigger condition may be the display of three or more trigger symbols 38. In another embodiment, the occurrences of trigger symbols 38 may be saved from game to game, and the secondary game is only triggered when a sufficient number of trigger symbols 38 have been accumulated. Other variations of the trigger condition are contemplated.

Since, in step 40, it has been determined that the trigger condition exists, attention is now drawn to the peripheral reels 15. This may be done with an animation. In the example, there are three possible scatter symbols, a circular gem, a hexagonal gem, and a triangular gem. The trigger symbols on the rightmost reel 13 also include a circular gem, a hexagonal gem, and a triangular gem. When one of the trigger symbol types 38 is displayed on the center reels 13, the same type gem symbols are highlighted on the peripheral reels 15. In the example, the trigger symbol 38 is a triangular gem symbol, and five triangular gem symbols are highlighted on the peripheral reels 15.

There is a paytable for the secondary game that associates the number of highlighted symbols with a particular award. The more highlighted symbols, the greater the award. Therefore, after the player initially sees the triangular gem trigger symbol 38 appear followed by the sequential stopping of the peripheral reels 15, the player is able to see the significance of the various reels 15 stopping on a triangular gem symbol. This order of stopping the various reels 13 and 15 maximizes player excitement since the player already knows the importance of achieving a particular scatter symbol.

In one embodiment, all the scatter symbols have the same value and there is no weighting of the scatter symbol pseudo-random selection. Similarly, the different trigger symbols have equal probabilities of occurring. In another embodiment, however, some scatter symbols are more valuable than others and the probabilities of the display of certain trigger symbols or the scatter symbols are weighted, such as by the arrangements of the various symbols on the reel strips.

In the example shown, each peripheral reel 15 has an equal number of each type of gem symbol on its reel strip. In another embodiment, there may also be blank symbol positions on the peripheral 15 that have no value.

In step 42, the player is granted an award for winning combinations of scatter symbols on the peripheral reels 15. Since there is no payline for the secondary game, the symbols are referred to as scatter symbols. FIG. 4 illustrates that the player was granted a bonus win of 250 extra credits for the five triangular gem symbols on the peripheral reels 15. There may be a minimum number of the same type of scatter symbol needed for a winning combination of scatter symbols.

The game then ends, and the flowchart goes back to step 30.

The concept of peripheral reels 15 surrounding a main game may be applied to any main game, where the main game triggers a secondary game involving the scatter symbols on the peripheral reels 15.

In another embodiment, trigger symbols are on multiple ones of the center reels 13, and the trigger symbols only serve to trigger the secondary game. For example, if three trigger symbols are obtained in the main game, the secondary game is played. The trigger symbols may be wild symbols for the main game. In this embodiment, the trigger symbols do not identify the relevance of any particular scatter symbol. The combinations of the various types of scatter symbols on the peripheral reels 15 are then cross-referenced to a paytable to identify a bonus award. In such an embodiment, the pseudo-random selection of the scatter symbols may be weighted so that higher value symbols are displayed less often.

In another embodiment, multiple center reels 13 have different trigger symbol types, and the display of each type of trigger symbol causes the secondary game to grant awards based on the same symbol types occurring in the peripheral reels 15. For example, the center reels 13 may display a triangular gem symbol and circular gem symbol. In such a case, the bonus award can be based on the number of triangular gem symbols and circular gem symbols occurring on the peripheral reels 15.

In another embodiment, there may be one or more trigger symbols on one of the center reels 13, such as the fifth reel, and the display of the trigger symbol results in the combination of symbols on the peripheral reels 15 being evaluated in any way by a paytable for determining the bonus award. The paytable may be similar to the paytable for the main game, but with different symbols, where different combinations of the different gem symbols are associated with different awards.

In another embodiment, the peripheral reels 15 only have blank positions and the same scatter symbol type, such as a single gem symbol. When a trigger condition occurs in the main game, the number of displayed scatter symbols determines the bonus award.

Many other variations are contemplated.

If there are no winning scatter symbol combinations, the player may be granted a consolation prize.

In another embodiment, a particular combination of the scatter symbols triggers another bonus game, such as a player-selection type game with a potentially high award. One such bonus game may present the player with an array of icons with hidden award values or award multipliers, and the player touches the icon(s) until the game is terminated. Any other bonus game is contemplated.

Figure 6:
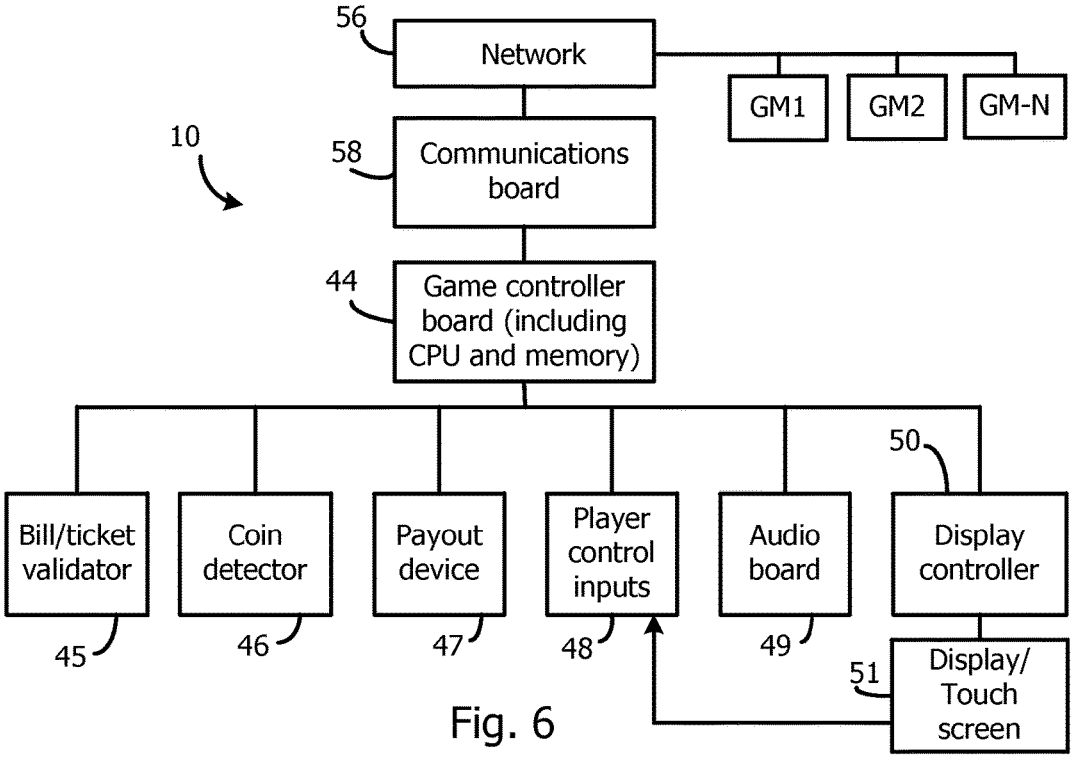
FIG. 6 is a block diagram of certain functional components in the programmed gaming machine of FIG. 1 and illustrates a network connected to linked gaming machines.

FIG. 6 illustrates basic circuit blocks in the machine 10 of FIG. 1. A game controller board 44 includes a processor (CPU) that runs the gaming program (including the secondary game) stored in a program ROM, such as a CD. The program ROM may include a pseudo-random number generator program for selecting symbols and for making other random selections. At least the active portion of the program is stored in a RAM on the board 44 for access by the processor. A pay table ROM on the board 44 detects the outcome of the game and identifies awards to be paid to the player. A bill/ticket validator 45 and coin detector 46 add credits for playing games. A payout device 47 pays out an award to the player in the form of coins or a printed ticket at the end of a game or upon the player cashing out. Player control inputs 48 receive push-button or touch-screen inputs for playing the game. An audio board 49 sends signals to the speakers. A display controller 50 receives commands from the processor and generates signals for the various displays 51. The touch screen portion of the displays 51 provides player selection signals to the processor.

The game controller board 44 transmits and receives signals to and from a network 56 via a communications board 58. The network 56 includes servers and other devices that monitor the linked gaming machines 10 and GM1-GM-N and provide communications between the machines 10 and GM1-GM-N.

The present invention may also be applied to a slot machine having physical, motorized reels in the center area, where the surrounding array of scatter symbols is either displayed on one or more video screens or is composed of physical reels themselves. The resulting display area will still resemble that of FIG. 2.

The term gaming machine or gaming device also applies to home computers, PDAs, cell phones, and other computer devices that carry out the game. The game may be carried out on a stand-alone machine, or on a machine connected to a server, or may be played on-line with a home computer connected to a server via the Internet, or may be played on a smartphone or tablet via the Internet, or by other processing devices.

The term "random" as used herein includes both pseudo-random and purely random.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method performed by a gaming device, the gaming device including a processing system, the method comprising:

providing a set of motor driven center reels;

providing one or more video screens for displaying a set of secondary reels that at least partially surrounds the center reels;

the processing system spinning and randomly stopping the set of center reels and the set of secondary reels, the secondary reels being configured to randomly display peripheral symbols, including scatter symbols, during a secondary game, wherein the scatter symbols displayed on the secondary reels are combinable only with each other in the secondary game to form winning symbol combinations of the scatter symbols in the secondary game, the center reels having at least one trigger symbol for triggering the secondary game involving the secondary reels, each of the secondary reels being independently spun and stopped and each of the secondary reels displaying at most one peripheral symbol, the center reels displaying an M×N array of symbols, where M and N are each greater than one;

determining, under control of the processing system, any winning symbol combinations in the M×N array of symbols;

detecting, under control of the processing system, that there is a trigger condition for playing the secondary game, the trigger condition being based on the display of one or more of the at least one trigger symbol;

determining, under control of the processing system, any winning symbol combinations by the scatter symbols displayed on the secondary reels, such winning symbol combinations by the scatter symbols not including any symbols displayed by the center reels; and granting, under control of the processing system, the player an award for any winning symbol combinations in the M×N array of symbols and a bonus award for any winning symbol combinations by only the peripheral symbols displayed on the secondary reels.

2. The method of claim 1 wherein the peripheral symbols comprise multiple types of peripheral symbols.

3. The method of claim 2 wherein the at least one trigger symbol comprises at least one trigger symbol for each type of peripheral symbol.

4. The method of claim 3 wherein a display of one type of trigger symbol on the center reels triggers play of the secondary game, the method further comprising granting an award for the secondary game based on a number of peripheral symbols displayed corresponding to the type of trigger symbol displayed on the center reels.

5. The method of claim 4 where the at least one trigger symbol is only on a single one of the center reels such that a maximum of one trigger symbol can be displayed in the M×N array.

6. The method of claim 1 wherein multiple center reels contain a trigger symbol, wherein the trigger condition comprises a display in the M×N array of a particular combination of trigger symbols.

7. The method of claim 6 wherein there are a plurality of types of peripheral symbols on the secondary reels.

8. The method of claim 1 wherein the peripheral reels contain only one type of peripheral symbol and blank reel positions.

9. The method of claim 1 wherein all possible stop positions of the secondary reels contain a peripheral symbol that may be used to create the winning symbol combinations.

10. The method of claim 1 wherein the at least one trigger symbol on the center reels acts as a wild symbol for the M×N array.

11. The method of claim 1 wherein the step of stopping the center reels and the secondary reels comprises stopping the center reels prior to stopping the secondary reels, and then sequentially stopping the secondary reels.

12. The method of claim 1 wherein the secondary reels completely surround the M×N array.

13. The method of claim 1 wherein there are five center reels each displaying three symbols, and there are 20 secondary reels, each secondary reel displaying at most one peripheral symbol.

14. The method of claim 1 wherein the gaming device is a computing device communicating with a server via the Internet.

15. The method of claim 1 further comprising the processing system detecting a special additional bet to activate the secondary game prior to the spinning of the center reels and secondary reels.

16. The method of claim 1 wherein the award for any winning symbol combinations by the peripheral symbols displayed on the secondary reels is at least one of a monetary award, an award multiplier, or a bonus game.

17. The method of claim 1 wherein multiple trigger symbols in the M×N array increase any award to the player based on winning combinations of symbols on the secondary reels.

18. The method of claim 1 wherein the award for any winning symbol combinations by peripheral symbols displayed on the secondary reels is based on a number of peripheral symbols of a particular type.

19. A gaming device comprising:

a set of motor driven center reels;

one or more video screens for displaying a set of secondary reels that at least partially surrounds the center reels;

at least one computer programmed to carry out the following steps:

spinning and randomly stopping the set of center reels and the set of secondary reels, the secondary reels being configured to randomly display peripheral symbols, including scatter symbols, during a secondary game, wherein the scatter symbols displayed on the secondary reels in the secondary game are combinable only with each other to form winning symbol combinations of the scatter symbols in the secondary game, the center reels having at least one trigger symbol for triggering the secondary game involving the secondary reels, each of the secondary reels being independently spun and stopped and each of the secondary reels displaying at most one peripheral symbol, the center reels displaying an M×N array of symbols, where M and N are each greater than one;

determining any winning symbol combinations in the M×N array of symbols;

detecting that there is a trigger condition for playing the secondary game, the trigger condition being based on the display of one or more of the at least one trigger symbol;

determining any winning symbol combinations by the scatter symbols displayed on the secondary reels, such winning symbols combinations by the scatter symbols not including any symbols displayed by the center reels; and granting the player an award for any winning symbol combinations in the M×N array of symbols and a bonus award for any winning symbol combinations by only the peripheral symbols displayed on the secondary reels.

20. The device of claim 19 wherein the secondary reels completely surround the M×N array.

* * * * *